United States Patent [19]

Alvis

[11] 4,185,335

[45] Jan. 29, 1980

[54] MOVABLE TOILET SEAT ASSEMBLY

[75] Inventor: Robert L. Alvis, Albuquerque, N. Mex.

[73] Assignee: Medical Aids Research Foundation, Albuquerque, N. Mex.

[21] Appl. No.: 908,801

[22] Filed: May 24, 1978

[51] Int. Cl.[2] ..... A47K 3/12

[52] U.S. Cl. ..... 4/251; 4/185 L; 297/330; 297/DIG. 10

[58] Field of Search ..... 4/251, 237, 185 L; 297/DIG. 10, 330, 347

[56] References Cited

U.S. PATENT DOCUMENTS

| | | | |
|---|---|---|---|
| 3,458,872 | 8/1969 | Hellstrom et al. | 4/237 |
| 3,473,174 | 10/1969 | Cool | 4/251 |
| 3,594,831 | 7/1971 | Brewer | 4/237 |
| 3,619,820 | 11/1971 | Cain et al. | 4/237 X |
| 4,031,576 | 6/1977 | Epstein | 4/251 |

*Primary Examiner*—Henry K. Artis
*Attorney, Agent, or Firm*—Robert W. Weig

[57] ABSTRACT

The disclosure relates to a movable toilet seat assembly for the infirm which allows a user to manually control seat position from an essentially standing position to a seated position and vice versa with minimum stress on the user's legs and joints.

7 Claims, 11 Drawing Figures

MOVABLE TOILET SEAT ASSEMBLY

FIELD OF THE INVENTION

The invention relates to toilet seat assemblies for the infirm, and more particularly to movable toilet seat assemblies providing controllable user body supporting movement from essentially standing to seated positions.

BACKGROUND OF THE INVENTION

There has been a long existing need to provide handicapped persons as well as the weak and infirm, such as post operative patients in hospital care, with toilet facilities for human waste excretion suitable for their use without assistance or minimal assistance from hospital or home nursing personnel. At present, many times two strong persons must physically assist an infirm person into and from a seated position on a toilet. This is a very difficult and awkward task. In addition, psychologically, the person being assisted normally would prefer to be as self-sufficient as possible in using the toilet. Too, difficult situations arise when hospital or nursing personnel are otherwise engaged or not available and the infirm person cannot use a toilet as desired.

It has been determined that psychologically, many elderly and failing persons tend to give up hope once they can no longer use a toilet without assistance from others. Thus, it is very desirable that a toilet facility be available which would offer maximum self-use by handicapped or infirm individuals.

Several such toilets have been proposed. Several related embodiments are described in U.S. Pat. No. 3,473,174 to Cool. The Cool devices function to lift their seats through a trajectory approximating the axis of articulation of knee joints. This forces a load upon a user's legs before they are straight, causing the user to have to exert himself to keep from sliding off the seat. Any such fixed hinge point devices will cause stress on a user to some extent. If a large radius is used, the elevated seat will be too horizontal in position, resulting in another high leg stress maneuver for the user to unseat himself.

Scissoring mechanisms are notoriously weak to side loading; the greater number of scissor members, the greater the weakness. Too, uncovered scissor members present obvious hazards to an unwary, careless or infirm user's body parts and clothing. It is extremely important that a movable toilet seat for the infirm provide stable support for a user at all times, and preferably allow its sanitary use at all times. The Cool seats do not provide stability for sanitary use at other than their full down positions. Spring loaded designs may assist healthy users, but offer little support or height control between seated or erect user positions.

The Cool designs furthermore do not provide ideal assistance to users having artificial knees and hip joints. Such users should not bend their artificial joints beyond 90° because bending beyond 90° can cause many artificial joints to uncouple. Use of the Cool mechanisms requires stress being placed on the leg members while the seat travels between its full down or seated and fully raised positions, causing any artificial joints to possibly be bent beyond 90° under stress.

The Cool patent suggests no adjustment mechanism for users of differing height, and the electrical switch and motor required to operate the Cool device create a potential electrocution hazard.

SUMMARY OF THE INVENTION

In accordance with the present invention there is provided a toilet seat assembly movable and adjustable within a preselected positional range. The assembly is removably fittable onto a conventional toilet bowl, such as with bolts. The water supply for the commode is tapped for water to provide hydraulic fluid for powering the assembly. A seat positioning mechanism is hydraulically powered at a users control by a hand activated valve to move the seat between its most elevated level and its lowest seating level in a preselected arc or path.

One object of the present invention is to provide for the infirm a toilet seat assembly capable of supporting a user between essentially a fully standing position and a fully seated position to enable such a person to use the toilet unassisted by others.

Another object of the present invention is to provide a toilet facility affording sanitary use at any point between essentially standing and seated positions.

Yet another object of the present invention is to provide a movable toilet seat assembly adjustable to suit users of different heights.

One advantage of the present invention is that it is safe, being free of potentially dangerous electrical control devices.

Another advantage of the instant invention is its inherent stability and structural rigidity at all positional points.

Still another advantage of the invention is protection from pinching of body parts and clothing offered by the housing of the invention.

Yet another advantage of the invention is that the arc of seat movement provided can be selected to lift an infirm person to a position in which his leg or legs are straight or nearly straight before applying any body load, to minimize leg stress.

BRIEF DESCRIPTION OF THE DRAWINGS

Other objects and advantages of the present invention will be apparent to those skilled in the art from the following description with reference to the appended drawings wherein like numbers denote like parts and wherein.

DETAILED DESCRIPTION OF THE INVENTION

Figure 8:
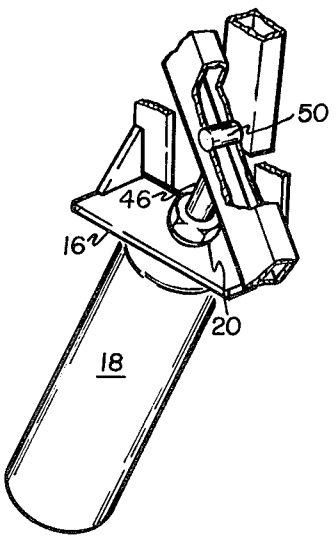
FIG. 8 shows a hydraulic cylinder rod to linkage connection.

Reference is now made to FIGS. 1, 2, 4 and 5 which illustrate a preferred embodiment of the invention in fully lowered and raised positions. A toilet seat assembly 10 may be mounted to a conventional commode 12 where a conventional toilet seat is affixed by bolts 15 attaching a frame 14 at the rear of the bowl to commode 12. Rigidly attached to frame 14 are brackets 16 to which hydraulic cylinders 18 are removably attached by nuts 20. Hydraulic cylinders 18 drive a linkage assembly 22 comprising longitudinal members 24 and 26 and vertical links 28. Longitudinal members 24 are rotatably affixed to frame 14 on bearings 30 in tabs 32 and are connected together by a torsion bar 34. Longitudinal members 26 are rotatably attached to frame 14 by bearings 38 in tabs 40 and are interconnected by a torsion bar 42. Vertical links 28 rotatably fasten to horizontal links 26 at bearings 44; vertical links 28, horizontal links 24 and hydraulic cylinder rods 46 all rotatably fasten together at bearings 50, as seen also in FIG. 8. The piston rod 46 of a cylinder 18 has its end threaded and screws into a threaded orifice in bearing 50. Vertical link 28 is open at its end and the open end is wide enough so that throughout the assembly's range of movement rod 46 does not bind on vertical link 28. When the rods 46 are pushed out from cylinders 18, they raise linkage 22 to the position shown in FIGS. 2 and 5.

Affixed to linkage 22 is a housing 52. Pins 54 in horizontal links 26 slidably engage and fit within the slots of slotted blocks 56 mounted onto the forward portion of the interior side walls 53 of housing 52 slightly disposed away from and parallel to its screws 57. Pins 58 on horizontal links 24 rotatably fit in holes in blocks 60 mounted on the rearward portions of the inside of the side walls 53 of housing 52 by screws 61. These pin-in-slot or shaft and linear bearing and pin-in-hole or shaft and bushing mountings assist in giving the unique and desired lifting arc needed to place the least possible stress on the physical capabilities of an infirm user of the assembly.

A funnel 62 having a retaining lip 64 releasably fits into the orifice in housing 52, and provides for sanitary disposal of waste at all positions of the assembly between its fully lowered and fully raised positions. If necessary, funnel 62 may be easily removed for cleaning after use.

Figures 1, 2, 3:
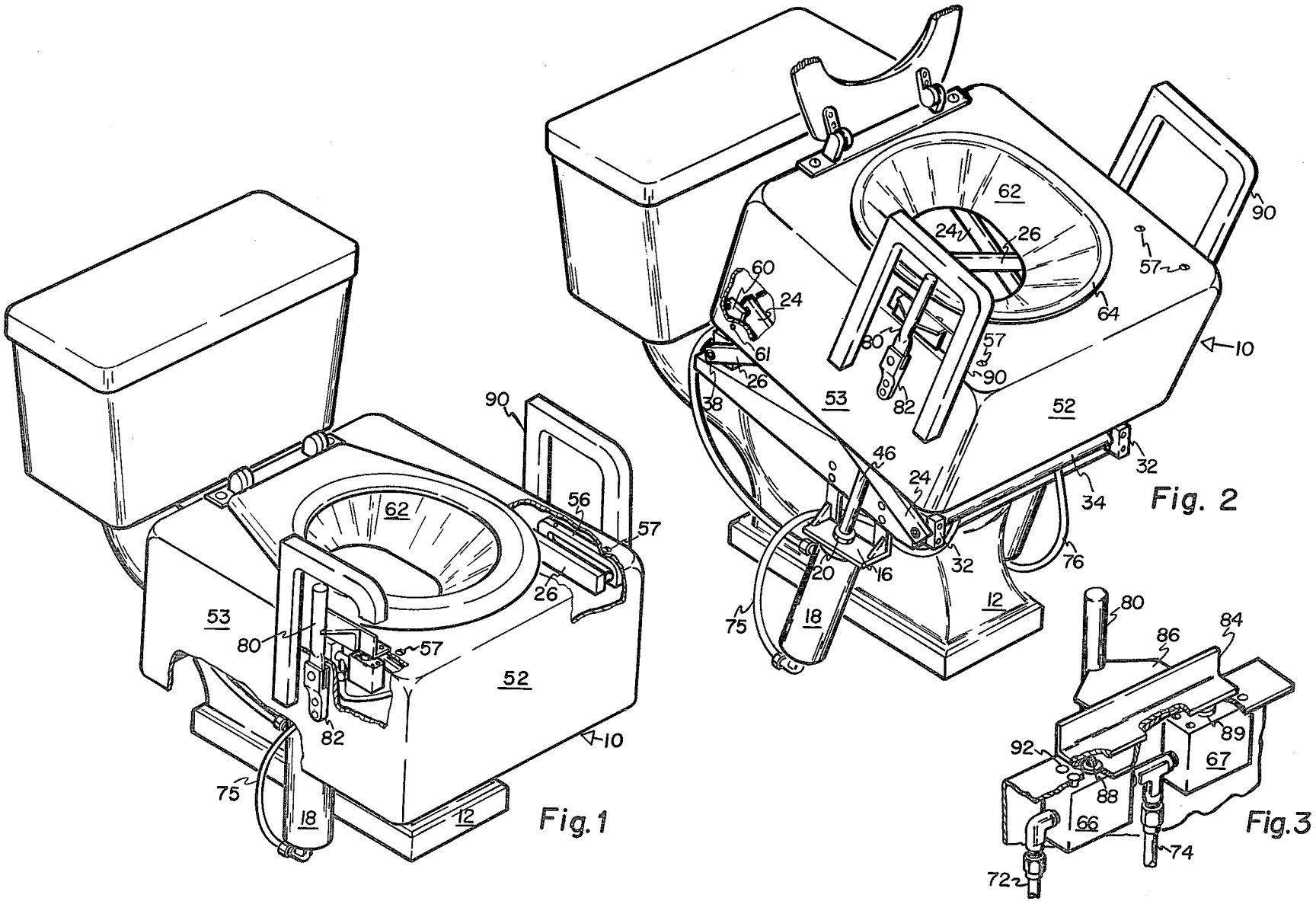
FIG. 1 illustrates a preferred embodiment of the invention with the toilet seat assembly at its fully lowered position.
FIG. 2 shows the preferred embodiment in a raised position.
FIG. 3 is a detailed showing of a hand operated mechanism for controlling the position of the seat assembly of the preferred embodiment.
Figure 5:
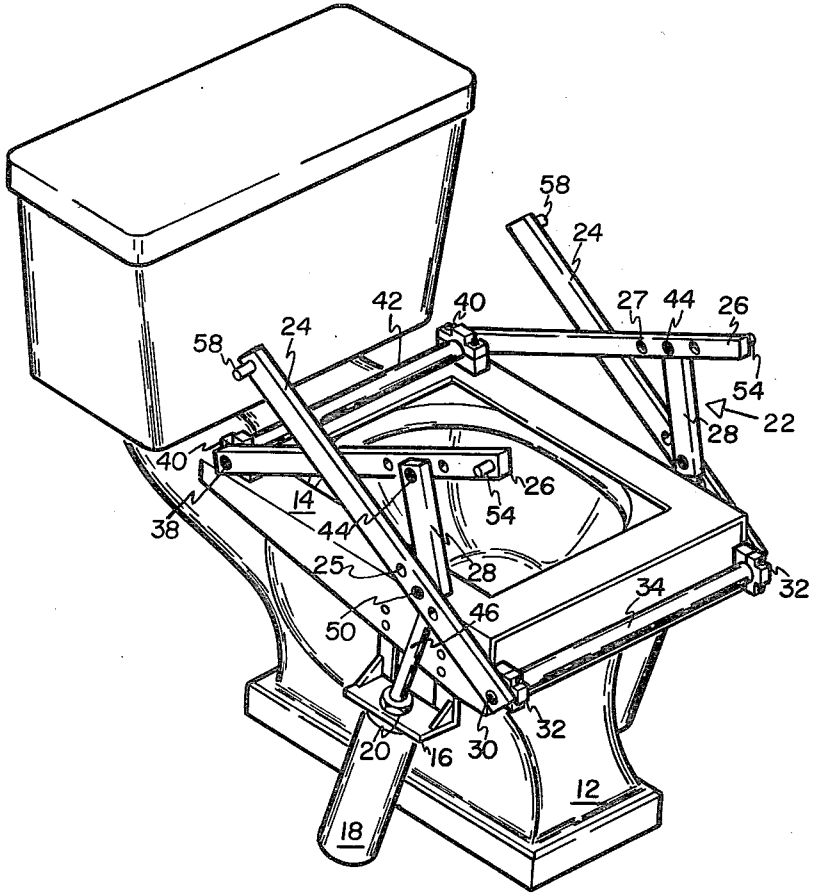
FIG. 5 illustrates the preferred embodiment's linkage in a raised position.
Figure 6:
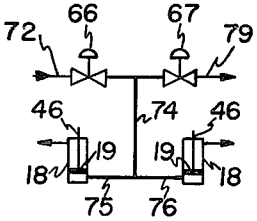
FIG. 6 schematically shows the hydraulic system of the preferred embodiment.
Figure 4:
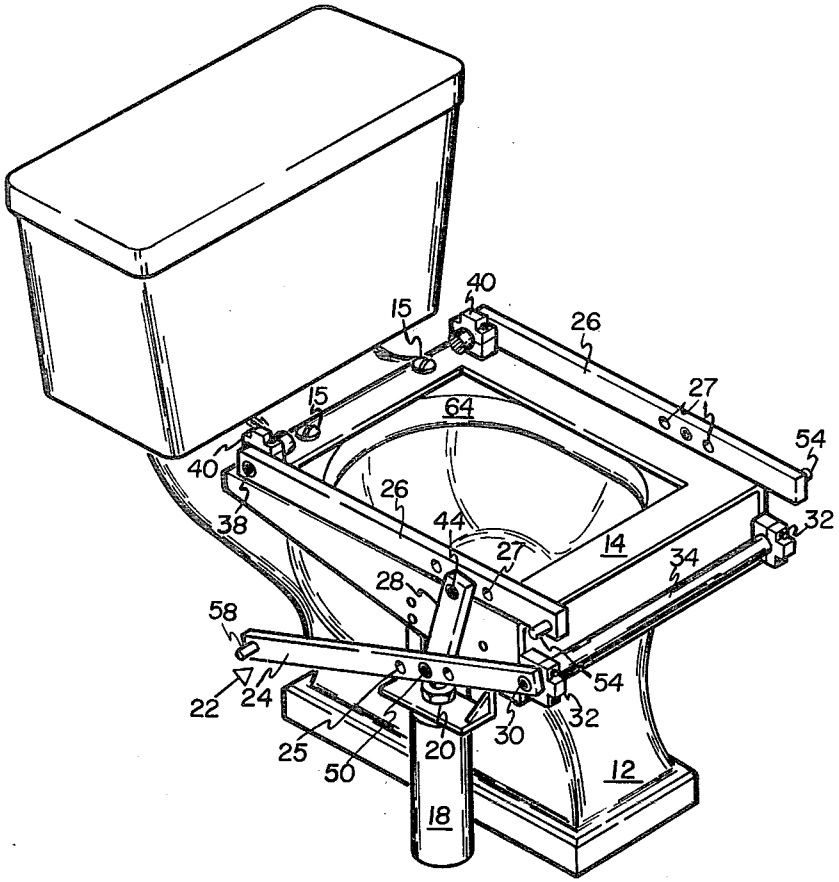
FIG. 4 depicts the linkage of the preferred embodiment in its fully lowered position.
Figure 7:
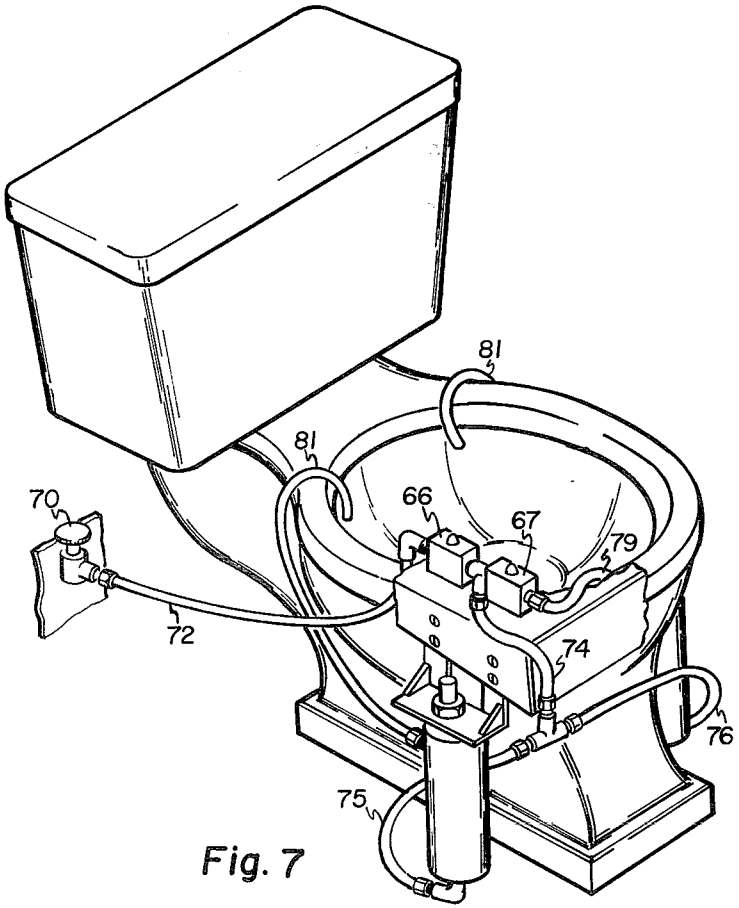
FIG. 7 pictorially shows the hydraulic system of the preferred embodiment.

FIG. 6 schematically shows the hydraulic system of the invention, showing cylinders 18, pistons 19 and rods 46, and valves 66 and 67, the latter seen also in FIG. 3. FIG. 7 shows how the hydraulic lines may be placed in practicing the preferred embodiment, the arrangement of FIG. 7 serving to pictorially illustrate the actual routing of lines as clearly as possible. A production device would advantageously have its lines routed to remain well out of sight and away from a user's clothing, the mechanical linkage, and the like.

As seen in FIGS. 6 and 7, water from a wall outlet 70 passes through a water pipe 72 to valve 66, which, when open, allows water to pass through lines 74, 75 and 76, enter cylinders 18 and force pistons 19 away from the end of water entry. This raises the toilet seat assembly by the action of piston rods 46 on linkage mechanism 22. Very importantly, the lifting or lowering action, to be described hereinafter, can be stopped at any time so that the seat can be caused to sturdily remain in any intermediate position between fully raised and fully lowered. Thus, an infirm person can better position himself while maintaining full control of seat action at all times. The control handle assembly is seen in FIG. 3 in reverse for the sake of clarity. The seat assembly is raised and lowered by manual use of a handle 80 pivotally mounted on bracket 82 affixed to side wall 53. Handle 80 is affixed to an angle iron 84 by a flange 86. Angle iron 84, when appropriately moved by handle 80, presses on one of actuators 88 and 89 to open one of the valves 66 and 67. When valve 67 is opened by use of handle 80 water from the cylinders 18 passes back through lines 75, 76 and 74, through valve 67 and out through line 79 into the bowl of the commode. Any water which may leak past pistons 19, drains back into the commode's bowl through lines 81.

Detachably affixed to housing 52 are handles 90 which are preferably adjustably affixed by means of screws. The handles contain a series of threaded holes into which screws, the heads of which are inserted from the inside of housing walls 53, are threaded. The position of the handles can thereby be adjusted for persons of different heights or preferences. Handles 90 are an important feature of the invention in that hand holds generally serve as important points of support for the infirm when going from standing to seated positions and vice versa.

Seat lifting are can be adjusted for users of different heights by selecting different holes 25 and 27 in horizontal members 24 and 26 to which the ends of vertical link 28 are pivotally affixed.

Figure 10:
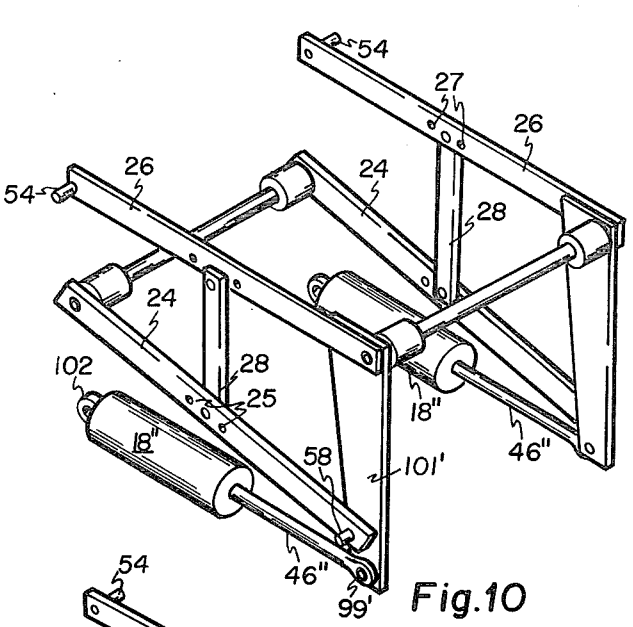
FIGS. 9, 10 and 11 depict alternative horizontal mountings for hydraulic cylinders in combination with linkage in accordance with the invention.
Figure 11:
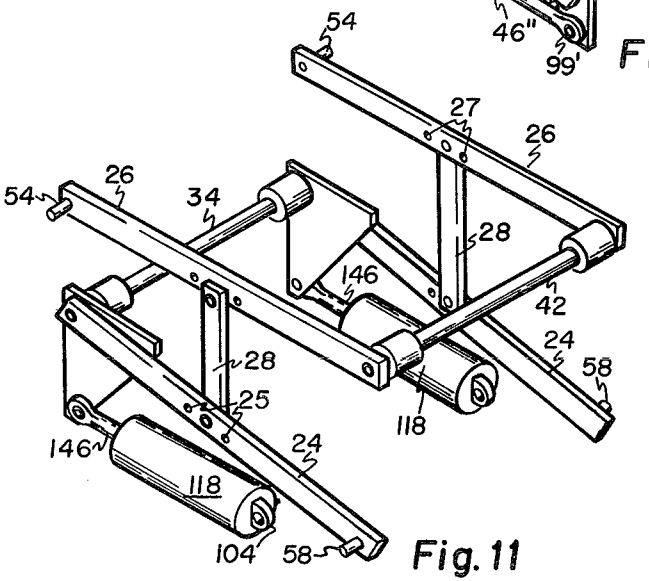
Figure 9:
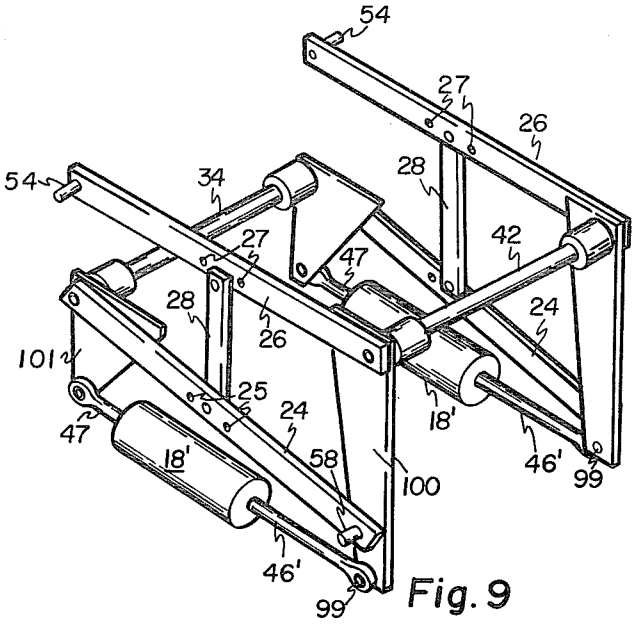

It will be apparent to those skilled in the art that the hydraulic cylinders 18 may be affixed at different positions with respect to linkage 22 and still function to accomplish the same result. Several variations of hydraulic cylinder mounting and hydraulic cylinder to linkage attachment are illustrated in FIGS. 9, 10 and 11. The illustrated embodiments are not intended to be all inclusive of such variations, but exemplary structures. It should be noted that as with the preferred embodiment, the lifting arcs of the linkages may be adjusted by providing several bearing placement positions in the longitudinal members.

In each of the embodiments shown in FIGS. 9, 10 and 11, the arc produced as an attached seat assembly is raised or lowered is the same as that provided by the preferred embodiment.

Longitudinal members 24 and 26 function with vertical members 28 as in the preferred embodiment, and a housing 52 is similarly adjustably attached by pins 58 into holes in blocks 60 and by pins 54 into slots in blocks 56.

FIG. 9 shows hydraulic cylinders 18' disposed horizontally. Such an embodiment provides for ease of cleaning the floor under the toilet seat assembly. Rod 46' of hydraulic cylinder 18' acts on a member 100 through a pivotal bearing 99 simultaneously with a second rod 47 acting on a second member 101 to move the linkage so that an attached housing 52 moves in the same manner as in the preferred embodiment of FIGS. 1 and 2.

Reference is now made to FIG. 10 which depicts another horizontally disposed hydraulic cylinder embodiment. The cylinder's piston rod 46" attaches to a member 101 through a pivotal bearing 99 as in FIG. 9. The other end of cylinder 18", having a bracket 102, may be attached to frame 14 by any desirable means, such as by a downwardly extending bracket, not shown for the sake of clarity. All forces applied by cylinder 18″ are exerted through a single torsion bar 42 in this embodiment, rather than through two torsion bars 34 and 42 as in the embodiment of FIGS. 1 and 9.

FIG. 11 illustrates a hydraulic cylinder 118 pivotally attached to a bracket 104 which may be affixed to frame 14, for example, by an extended bracket. The cylinder rod 146 of cylinder 118 transmits force to raise an attached seat assembly through torsion bar 34. Once again, linkage movement is identical to that of the preferred embodiment.

FIGS. 9, 10 and 11 also show vertical links 28 which can be selectively attached to horizontal links 24 and 26 at a plurality of points 25 and 27 to adjust the lifting arc or trajectory of a housing 52 appropriately affixed thereto.

The various features and advantages of the invention are thought to be clear from the foregoing description. However, various other features and advantages not specifically enumerated will undoubtedly occur to those versed in the art, as likewise will many variations and modifications of the preferred embodiment illustrated, all of which may be achieved without departing from the spirit and scope of the invention as defined by the appended claims.

I claim:

1. A toilet seat assembly particularly adapted for use by handicapped persons, movable and adjustable within a preselected positional range, said assembly being fittable to a conventional toilet bowl having a conventional water supply, said assembly comprising:

means for affixing said assembly to said conventional toilet bowl;

means for tapping said conventional water supply and for hydraulically powering said assembly;

means operatively connected to said hydraulic powering means for providing a range of human body supporting positions for said assembly, said range of positions being from a lowered, knees-bent seater user position, essentially vertically, to an intermediate raised user supporting position essentially without transfer of weight to a user's legs, therefrom forward and slightly upward arcuately to a fully extended position, gradually transfering the weight of the user to the user's feet, said affixing means comprising an essentially rectangular frame affixable on said conventional toilet bowl, said frame having a front and a back corresponding to the front and back of a conventional toilet bowl, said positional range means comprising a first pair of parallel longitudinal members having first and second ends, interconnected at said first ends by a first torsion bar pivotally mounted on the front of said frame, a second pair of parallel longitudinal members having first and second ends, interconnected at said first ends by a second torsion bar pivotally mounted on the rear of said frame, a pair of vertical links pivotally interconnecting respective first and second longitudinal members, each of said vertical links being pivotally attached at one end to a first longitudinal member and at its other end to a second longitudinal member at corresponding selected points along the lengths thereof, means disposed at said second ends of said first and second longitudinal members for mounting an assembly enclosing housing on which a conventional toilet seat may be mounted; and means operatively connected to said hydraulic powering means for a user to manually control positional movement of said seat assembly.

2. The invention of claim 1 wherein said vertical interconnecting links are pivotally attachable in a plurality of positions on at least one pair of corresponding longitudinal members to provide a plurality of differing paths for said positional range means.

3. The invention of claim 1 wherein said assembly affixing means comprises bolts positioned to affix said frame to a conventional toilet bowl through the orifices provided thereon for toilet seat affixation.

4. The invention of claim 1 further comprising adjustably affixable armrests attachable to said assembly to provide arm support and hand holds for a user.

5. The invention of claim 1 further comprising means for sanitarily conducting waste from said assembly seat into said conventional toilet bowl from any position in said positional range.

6. The invention of claim 1 wherein said hydraulic powering means comprises at least one hydraulic cylinder.

7. The invention of claim 1 wherein said second ends of said first and second longitudinal members comprise pins extending laterally therefrom and said housing comprises means for pivotally receiving said pins on said first longitudinal members and means for pivotally and slidably receiving said pins on said second longitudinal members.

* * * * *